US006101349A

United States Patent [19]

Ohashi et al.

[11] Patent Number: 6,101,349

[45] Date of Patent: Aug. 8, 2000

[54] IMAGE-FORMING MACHINE HAVING AN IMAGE FORMING UNIT MOVABLE FROM AN ACTING POSITION TO A NON-ACTING POSITION

[75] Inventors: Hiroaki Ohashi; Kiyoaki Miyamoto; Kazuya Kamidaira; Tadakazu Ohgiri; Hideki Ishida; Hironobu Kohno, all of Osaka, Japan

[73] Assignee: Kyocera Mita Corporation, Osaka, Japan

[21] Appl. No.: 09/287,130

[22] Filed: Apr. 7, 1999

[30] Foreign Application Priority Data

| | | | |
|---|---|---|---|
| Apr. 22, 1998 | [JP] | Japan | 10-112144 |
| Apr. 23, 1998 | [JP] | Japan | 10-100708 |
| Apr. 28, 1998 | [JP] | Japan | 10-118406 |

[51] Int. Cl.[7] ..... G03G 21/18; G03G 15/01

[52] U.S. Cl. ..... 399/110; 399/112; 399/299

[58] Field of Search ..... 399/110, 111, 399/112, 113, 126, 167, 299

[56] References Cited

U.S. PATENT DOCUMENTS

| | | | |
|---|---|---|---|
| 4,708,455 | 11/1987 | Kubota et al. | 399/111 |
| 5,014,094 | 5/1991 | Amitani et al. | 399/112 X |
| 5,303,018 | 4/1994 | Terada et al. | 399/299 |
| 5,552,857 | 9/1996 | Ishikawa | 399/113 |
| 5,745,825 | 4/1998 | Okawa et al. | 399/112 X |
| 5,758,243 | 5/1998 | Haneda et al. | 399/111 X |

*Primary Examiner*—Susan S. Y. Lee

*Attorney, Agent, or Firm*—Smith Gambrell & Russell, LLP

[57] ABSTRACT

An image-forming machine which has an image-forming unit that moves substantially horizontally between an acting position in a housing and a non-acting position that is drawn out forward. The image-forming unit has a frame having a front wall member and a rear wall member, and a plurality of image-forming devices mounted on the frame. The front wall has a pair of receiving holes arranged at a distance in the transverse direction and the rear wall has a pair of pins located at a distance in the transverse direction. In a preferred embodiment, the housing has a pair of pins located in the front and a pair of receiving holds in the rear such that when the image-forming unit is brought to the acting position, the receiving holes of the front wall engage the front pins of the housing and the pins on the rear wall engage the receiving holes in the rear of the housing. Each of the image-forming devices includes a rotary shaft, a rotary drum mounted on the rotary shaft, and bearing members fitted to both ends of the rotary shaft. The bearing members have a cylindrical outer peripheral surface. Both the front and rear wall members have a mounting plate with mounting notches that are opened upward. The mounting notches have two support edges which, when the bearing members of the image-forming devices are introduced therein from the upper side, support the bearing members. Releasable locking members are also provided to lock the image-forming devices in position.

13 Claims, 9 Drawing Sheets

IMAGE-FORMING MACHINE HAVING AN IMAGE FORMING UNIT MOVABLE FROM AN ACTING POSITION TO A NON-ACTING POSITION

FIELD OF THE INVENTION

The present invention relates to an image-forming machine equipped with an image-forming unit that is allowed to freely move between an acting position in a housing and a non-acting position drawn out from the acting position. More specifically, the invention relates to an image-forming machine capable of forming a color image and equipped with an image-forming unit that freely moves, in which there are arranged a plurality of image-forming means for forming toner images of different colors, though the invention is not limited thereto only.

DESCRIPTION OF THE PRIOR ART

As is widely known among people skilled in the art, there have heretofore been proposed image-forming machines such as printer, copying machine and facsimile and, particularly, the one capable of forming color images selectively, which comprises an image-forming unit that is allowed to freely move between an acting position in a housing and a non-acting position drawn out from the acting position. The image-forming unit includes a frame on which are mounted four image-forming means arranged in tandem, i.e., a black toner image-forming means, a magenta toner image-forming means, a cyan toner image-forming means and a yellow toner image-forming means. Each of these image-forming means is provided with a rotary drum having an electrostatic photosensitive material disposed on the peripheral surface thereof. A transfer belt means is usually arranged beneath the image-forming unit. When a color image is formed, a black toner image, a magenta toner image, a cyan toner image and a yellow toner image are formed on the rotary drums of the four image-forming means and then, these toner images are successively transferred onto a sheet member that is conveyed by a transfer belt means, whereby the color image is formed on the sheet member.

In the image-forming machine of the above-mentioned type, when, for example, the sheet members are jammed in the conveyer passage or when the toner is exhausted in any of the image-forming means, the image-forming unit must be drawn out from the acting position in the housing to the non-acting position to remove the jammed sheet members or to replenish the toner and, then, the image-forming unit must be returned back to the acting position in the housing. Moreover, when the rotary drums have aged in the image-forming means in the image-forming unit, the image-forming unit must be drawn out from the acting position in the housing to the non-acting position to allow removal of the image-forming means from the frame so that it may be repaired or replaced by a new one. And then, the repaired or newly replaced one must be again mounted on the frame and, thereafter, the image-forming unit must be returned back to the acting position in the housing.

In order to form a good color image stably, on the other hand, it is important that the frame of the image-forming unit is brought to the acting position in the housing with a sufficient degree of precision, and that the image-forming means are mounted on the frame at their predetermined positions with the utmost precision.

In the image-forming machine of the above-mentioned type, therefore, it is desired to move the image-forming unit between. the acting position in the housing and the non-acting position drawn out from the acting position very easily and quickly and to bring the image-forming unit to the acting position with great precision without causing the structure to become too complex and without increasing the cost of production. It is further desired to very easily and quickly attach/detach the image-forming means to/from the frame of the image-forming unit and to bring the image-forming means to their predetermined positions with a sufficient degree of certainty without causing the structure to become too complex and without increasing the cost of production. In practice, however, the existing image-forming machines are still not capable of satisfying the above-mentioned requirements to a sufficient degree.

SUMMARY OF THE INVENTION

The object of the present invention is to provide a novel and improved image-forming machine which, without creating distinct problems such as a great increase in the cost of production or the like, enables the image-forming unit to move between an acting position in a housing and a non-acting position drawn out from the acting position very easily and quickly, and to be brought to the acting position with a sufficient degree of precision.

Another object of the present invention is to provide a novel and improved image-forming machine which, without raising a new problem such as a great increase in the cost of production or the like, enables the image-forming means to be detached from, and attached to, the frame of the image-forming unit very easily and quickly, and to be mounted on their predetermined positions with a sufficient degree of precision.

In order to accomplish the above-mentioned objects according to one aspect of the present invention, there is provided an image-forming machine comprising a housing and an image-forming unit allowed to freely move substantially horizontally between an acting position in said housing and a non-acting position drawn out forward from said acting position, said image-forming unit including a frame that has a front wall member and a rear wall member arranged at a distance in the back-and-forth direction;

wherein a pair of position-limiting means are arranged at a distance in the transverse direction on each of said front wall member and said rear wall member of said frame in said image-forming unit, and said housing includes a pair of front stationary position-limiting means and a pair of rear stationary position-limiting means, and when said image-forming unit is brought to said acting position, said pair of position-limiting means of said front wall member work in cooperation with said pair of front stationary position-limiting means and said pair of position-limiting means of said rear wall member work in cooperation with said pair of rear stationary position-limiting means, so that said image-forming unit is limited to said acting position.

Desirably, amongst said pair of position-limiting means of said front wall member and of said pair of front stationary position-limiting means there is included a first pair of receiving holes that extend substantially horizontally, and first pair of pins that extend substantially horizontally; and, amongst said pair of position-limiting means said rear wall member and said pair of rear stationary position-limiting means there is included a second pair of pins that extend substantially horizontally, and and a second pair of receiving holes that extend substantially horizontally. According to a preferred embodiment, amongst said first and second pairs of pins there is included round pins having a circular shape in cross section, and, amongst said first and second pairs of receiving holes, there is included receiving holes having a circular shape with an inner diameter corresponding to an outer diameter of a respective round pin positioned for insertion therein, and there is further included another receiving hole that has an elongated shape that extends maintaining a width corresponding to an outer diameter of a respective round pin positioned for insertion therein. Annular shoulder surfaces are formed on said first pair of pins, and front ends of said first pair of receiving holes come into contact with said annular shoulder surfaces thereby to limit the position of said image-forming unit in the back-and-forth direction. Or, annular shoulder surfaces are formed on said second pair of pins means, and the front ends of said second pair of receiving holes come into contact with said annular shoulder surfaces thereby to limit the position of said image-forming unit in the back-and-forth direction. It is desired that locking means are disposed to releasably lock said image-forming unit at said acting position. According to a preferred embodiment, said image-forming unit includes four image-forming means that are mounted on said frame, arranged in tandem, in a direction which is substantially perpendicular to the direction in which said image-forming unit moves and is substantially horizontal, said four image-forming means being a black toner image-forming means, a magenta toner image-forming means, a cyan toner image-forming means and a yellow toner image-forming means.

In order to accomplish the above-mentioned objects according to another aspect of the present invention, there is provided an image-forming machine comprising a housing and an image-forming unit allowed to freely move between an acting position in said housing and a non-acting position drawn out from said acting position, said image-forming unit including a frame that has a front wall member and a rear wall member arranged at a distance in the back-and-forth direction, and at least one image-forming means detachably mounted on said frame, and said image-forming means including a rotary shaft, a rotary drum mounted on said rotary shaft, and bearing members fitted to both ends of said rotary shaft, said bearing members having a cylindrical outer peripheral surface;

wherein each of said front wall member and said rear wall member of said frame includes a mounting plate having mounting notches that are opened upward, and said mounting notches have two support edges which, when said bearing members of said image-forming means are introduced into said mounting notches from the upper side, support said bearing members at two positions which maintain a distance in the circumferential direction on the outer peripheral surfaces of said bearing members.

According to a preferred embodiment, said frame has four image-forming means that are mounted thereon, arranged in tandem, in a direction which is substantially perpendicular to the direction in which said image-forming unit moves and is substantially horizontal, said four image-forming means being a black toner image-forming means, a magenta toner image-forming means, a cyan toner image-forming means and a yellow toner image-forming means. It is desired that the support edges extend straight. According to a preferred embodiment, each mounting plate has mounting slits that extend downward from said mounting notches between said two support edges, said image-forming means has engaging pins that are positioned beneath said bearing members and protrude substantially in parallel with said rotary shaft, said mounting slits have a width corresponding to the outer diameter of said engaging pins, and said engaging pins are introduced into said mounting slits so that said bearing members are supported by said two support edges. Locking members are mounted on said mounting plate to freely move between a locking position and an unlocking position and, when said locking members are moved from said unlocking position to said locking position after said engaging pins are introduced into said mounting slits, said locking members engage with said engaging pins from the upper side to prevent said engaging pins from moving upward in said mounting slits. Said locking members are mounted to freely turn between said locking position and said unlocking position. Said locking members have pairs of arm portions for defining a locking slit having a width corresponding to the outer diameter of said engaging pins, and when said locking members are located at said unlocking positions, ones of said pairs of arms extend across said mounting slits and the other ones of said pairs of arms retract from said mounting slits, and when said engaging pins are introduced into said mounting slits, said engaging pins are introduced into said locking slits and come into contact with the ones of said pairs of arms to cause said locking members to move from said unlocking positions to said locking positions, whereby the ones of said pairs of arms are positioned beneath said engaging pins and the other ones of said pairs of arms are positioned above said engaging pins. Desirably, resilient urging means are disposed to resiliently urge said locking members toward said unlocking positions with a relatively small force. In said housing, there is disposed a transfer belt means positioned beneath said image-forming unit when said image-forming unit is located at said acting position, said transfer belt means includes a lift frame that freely ascends and descends between an ascended position and a descended position, and said lift frame is provided with resilient urging means which are separated away from said locking members when said lift frame is located at said descended position, but, when said lift frame is brought to said ascended position, come in contact with said locking members to resiliently urge said locking members toward said locking positions with a relatively large force. Instead of the locking members, there can be disposed holding members in said mounting slits to resiliently hold said engaging pins that are introduced into said mounting slits.

DETAILED DESCRIPTION OF THE PREFERRED EMBODIMENTS

Preferred embodiments of the image-forming machine constituted according to the present invention will now be described in further detail with reference to the accompanying drawings.

Figure 1:
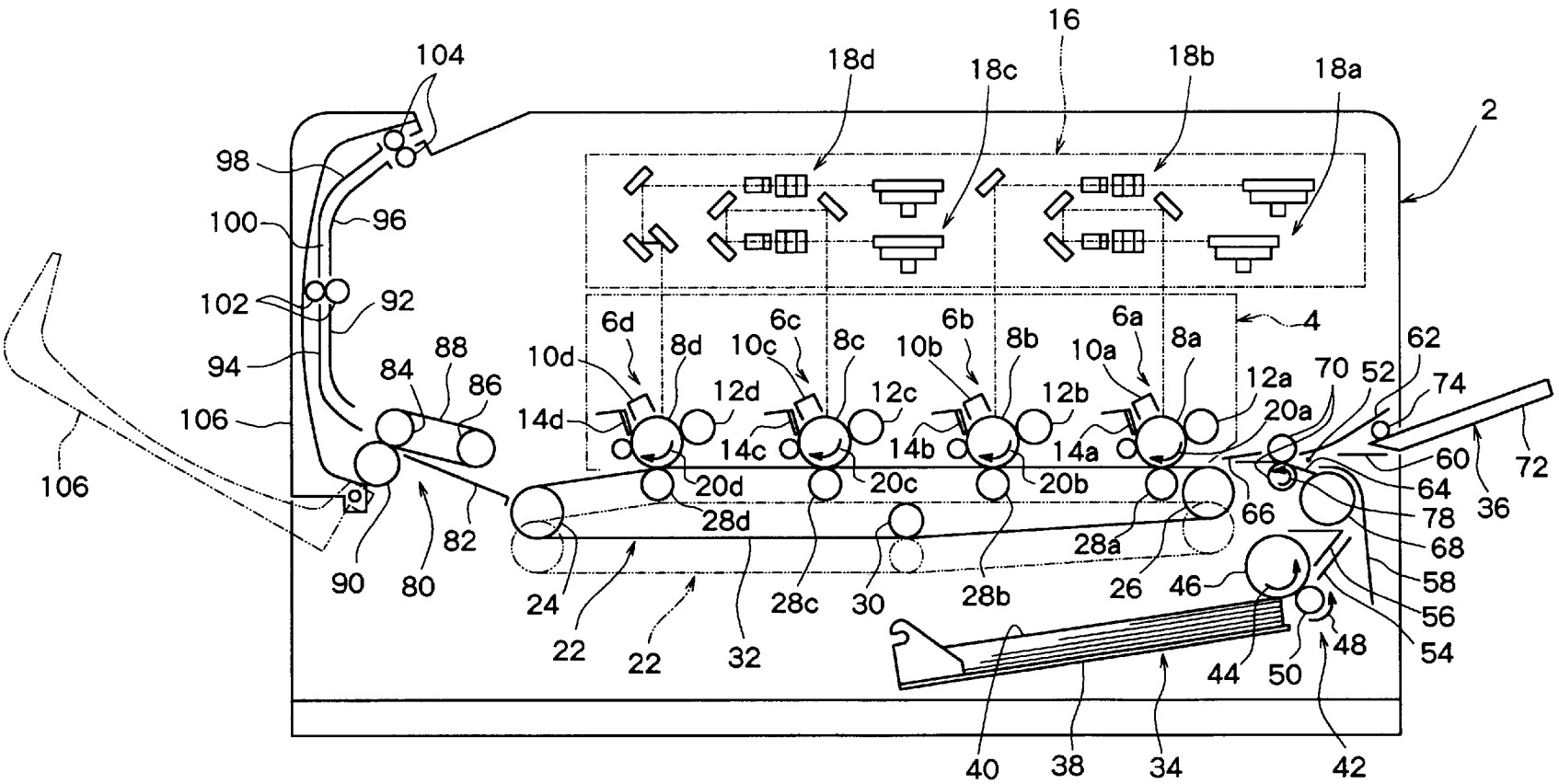
FIG. 1 is a sectional view schematically illustrating the entire image-forming machine constituted according to a preferred embodiment of the present invention.

FIG. 1 schematically illustrates the entire constitution of a color image-forming machine constituted according to the present invention. The illustrated image-forming machine is equipped with a housing 2 of nearly a rectangular parallelopiped shape. An image-forming unit 4 is arranged nearly at the central portion of the housing 2. On the image-forming unit 4 are mounted four image-forming means, i.e., a black toner image-forming means 6*a*, a magenta toner image-forming means 6*b*, a cyan toner image-forming means 6*c* and a yellow toner image-forming means 6*d*. As will be described later in detail, the image-forming unit 4 is equipped with a frame which is allowed to freely move substantially horizontally between an acting position in the housing 2 and a non-acting position drawn forward in a direction perpendicular to the surface of the paper in FIG. 1 from the acting position. On the frame, the above-mentioned image-forming means 6*a*, 6*b*, 6*c* and 6*d* are mounted. The image-forming means 6*a*, 6*b*, 6*c* and 6*d* include, respectively, rotary drums 8*a*, 8*b*, 8*c* and 8*d*, which are surrounded by charging means 10*a*, 10*b*, 10*c* and 10*d*, developing means 12*a*, 12*b*, 12*c* and 12*d*, and cleaning means 14*a*, 14*b*, 14*c* and 14*d*. An electrostatic photosensitive material is disposed on the peripheral surfaces of the rotary drums 8*a*, 8*b*, 8*c* and 8*d*.

If further described with reference to FIG. 1, in the housing 2 is arranged an optical unit 16 positioned above the image-forming unit 4. The optical unit 16 includes four optical means, i.e., an optical means 18*a* for forming a black toner image, an optical means 18*b* for forming a magenta toner image, an optical means 18*c* for forming a cyan toner image and an optical means 18*d* for forming a yellow toner image. The optical means 18*a*, 18*b*, 18*c* and 18*d* may be of a known form including a source of a laser beam (not shown) and optical elements such as rotary polyhedral mirrors, lenses, reflectors and the like for laser beam scanning. To form a black toner image, the peripheral surface of the rotary drum 8*a* that is rotated in a direction indicated by an arrow 20*a* is electrically charged uniformly by a charging means 10*a*. Then, the electric charge is selectively removed from the peripheral surface of the rotary drum 8*a* by the irradiation with light from the optical means 18*a* and, thus, an electrostatic latent image is formed on the peripheral surface of the rotary drum 8*a*. Then, the electrostatic latent image is developed into a black toner image by the developing means 12*a*. The black toner image is, then, transferred onto a sheet member in a manner that will be described later. After the image has been transferred, the black toner remaining on the rotary drum 8*a* is removed by the cleaning means 14*a*. A magenta toner image, a cyan toner image and a yellow toner image are formed on the rotary drums 8*b*, 8*c* and 8*d* that are rotated in the directions indicated by arrows 20*b*, 20*c* and 20*d* substantially in the same manner as described above. The image-forming means 6*a*, 6*b*, 6*c* and 6*d*, and the optical means 18*a*, 18*b*, 18*c* and 18*d* may be of known forms, and do not constitute a novel feature of the image-forming machine that is improved by the present invention, and are not, hence, described in detail in this specification.

In the housing 2 is further disposed a transfer belt means 22. The transfer belt means 22 is mounted to be allowed to freely ascend and descend between an active position indicated by a solid line in FIG. 1 and a non-acting position indicated by a two-dotted chain line in FIG. 1. The illustrated transfer belt means 22 includes a driven roller 24, a tension roller 26, a black toner image-transfer roller 28*a*, a magenta toner image-transfer roller 28*b*, a cyan toner image-transfer roller 28*c*, a yellow toner image-transfer roller 28*d*, an auxiliary roller 30, and an endless belt 32 wrapped round them. When the transfer belt means 22 is brought to the acting position, the transfer rollers 28*a*, 28*b*, 28*c* and 28*d* are positioned being respectively opposed to the rotary drums 8*a*, 8*b*, 8*c* and 8*d* of the image-forming means 6*a*, 6*b*, 6*c* and 6*d* enabling the endless belt 32 to be brought into contact with (or close to) the rotary drums 8*a*, 8*b*, 8*c* and 8*d*. When the transfer belt means 22 is descended to the non-acting position from the acting position, on the other hand, the endless belt 32 is lowered to separate away from the rotary drums 8*a*, 8*b*, 8*c* and 8*d* of the image-forming means 6*a*, 6*b*, 6*c* and 6*d*.

If further described with reference to FIG. 1, a first sheet member feed means 34 and a second sheet member feed means 36 are disposed in the illustrated image-forming machine. The first sheet member feed means 34 includes a sheet member-placing plate 38 on which a plurality of pieces of sheet members 40 will be placed, and a sheet member-sending means 42 for delivering sheet members 40 piece by piece from the placing plate 38. The sheet member-sending means 42 is constituted by a sending roller 46 that rotates in a direction indicated by an arrow 44 and a separation roller 50 that rotates in a direction indicated by an arrow 48. The sheet member 40 fed from the first sheet member feed means 34 passes through a conveyer passage 52 and is fed to the above-mentioned transfer belt means 22. The conveyer passage 52 is defined by guide plates 54, 56, 58, 60, 62, 64 and 66. In the conveyer passage 52 are disposed a conveyer roller 68 and a pair of resist rollers 70. The second sheet member feed means 36 includes a sheet member-placing plate 72 on which a plurality of pieces of sheet members 40 will be placed, and a sending roller 74 for delivering the sheet members 40 piece by piece from the placing plate 72. The sheet member 40 fed from the second sheet member feed means 36 passes through between the guide plate 62 and the guide plate 60, and is fed to the pair of resist rollers 70. The pair of resist rollers 70 are rotated in a direction indicated by an arrow 78 in synchronism with the operations of the image-forming means 6*a*, 6*b*, 6*c* and 6*d*, so that the sheet member 40 fed from the first sheet member feed means 34 or the second sheet member feed means 36 is fed to the transfer belt means 22 or, more specifically, to between the endless belt 32 of the transfer belt means 22 at the acting position indicated by a solid line and the rotary drums 8*a*, 8*b*, 8*c* and 8*d* of the image-forming means 6*a*, 6*b*, 6*c* and 6*d*. The first sheet member feed means 34 and the second sheet member feed means 36 may be of known forms, and are not described in detail in this specification.

A fixing means 80 is disposed on the downstream side of the transfer belt means 22, and a guide plate 82 is disposed between the fixing means 80 and the transfer belt means 22. The fixing means 80 which may be of a known form is constituted by an endless belt 88 wrapped round a fixing roller 84 and a heating roller 86, and a pushing roller 90. A discharge passage 100 is defined by guide plates 92, 94, 96 and 98 on the downstream side of the fixing means 80, and a pair of conveyor rollers 102 and 104 are disposed in the discharge passage 100. The discharge passage 100 extends up to a receiving portion formed on the upper surface of the housing 2. In the illustrated image-forming machine, there is further disposed a receiving tray 106 that is selectively brought to a non-acting position indicated by a solid line and an acting position indicated by a two-dotted chain line. Between the fixing means 80 and the discharge passage 100, there is disposed a discharge direction change-over means (not shown to simplify the drawing) for selectively guiding the sheet member 40 sent from the fixing means 80 to either the discharge passage 100 or the receiving tray 106 located at the acting position.

To form a color image by using the above-mentioned image-forming machine, the sheet member 40 sent from the first sheet member feed means 34 or the second sheet member feed means 36 is conveyed passing through between the image-forming unit 4 and the transfer belt means 22. At this moment, onto the sheet member 40 are successively transferred a black toner image from the rotary drum 8*a* of the image-forming means 6*a*, a magenta toner image from the rotary drum 8*b* of the image-forming means 6*b*, a cyan toner image from the rotary drum 8*c* of the image-forming means 6*c*, and a yellow toner image from the rotary drum 8*d* of the image-forming means 6*d*. Thus, a color image is formed on the sheet member 40. Through the fixing means 80, the color image is fixed on the sheet member 40, and the sheet member 40 is then discharged through the discharge passage 100 onto the receiving portion formed on the upper surface of the housing 2 or onto the receiving tray 106 located at the acting position indicated by a two-dotted chain line. To form a black image on the sheet member 40, the black toner image is transferred onto the sheet member 40 from the rotary drum 8*a* of the image-forming means 6*a*. Here, however, the toner images are not transferred onto the sheet member 40 from the rotary drums 8*b*, 8*c* and 8*d* of other image-forming means 6*b*, 6*c* and 6*d* (in this case, the transfer rollers 28*b*, 28*c* and 28*d* of the transfer belt means 22 are retracted to be slightly lower than the positions indicated by solid lines).

Figure 2:
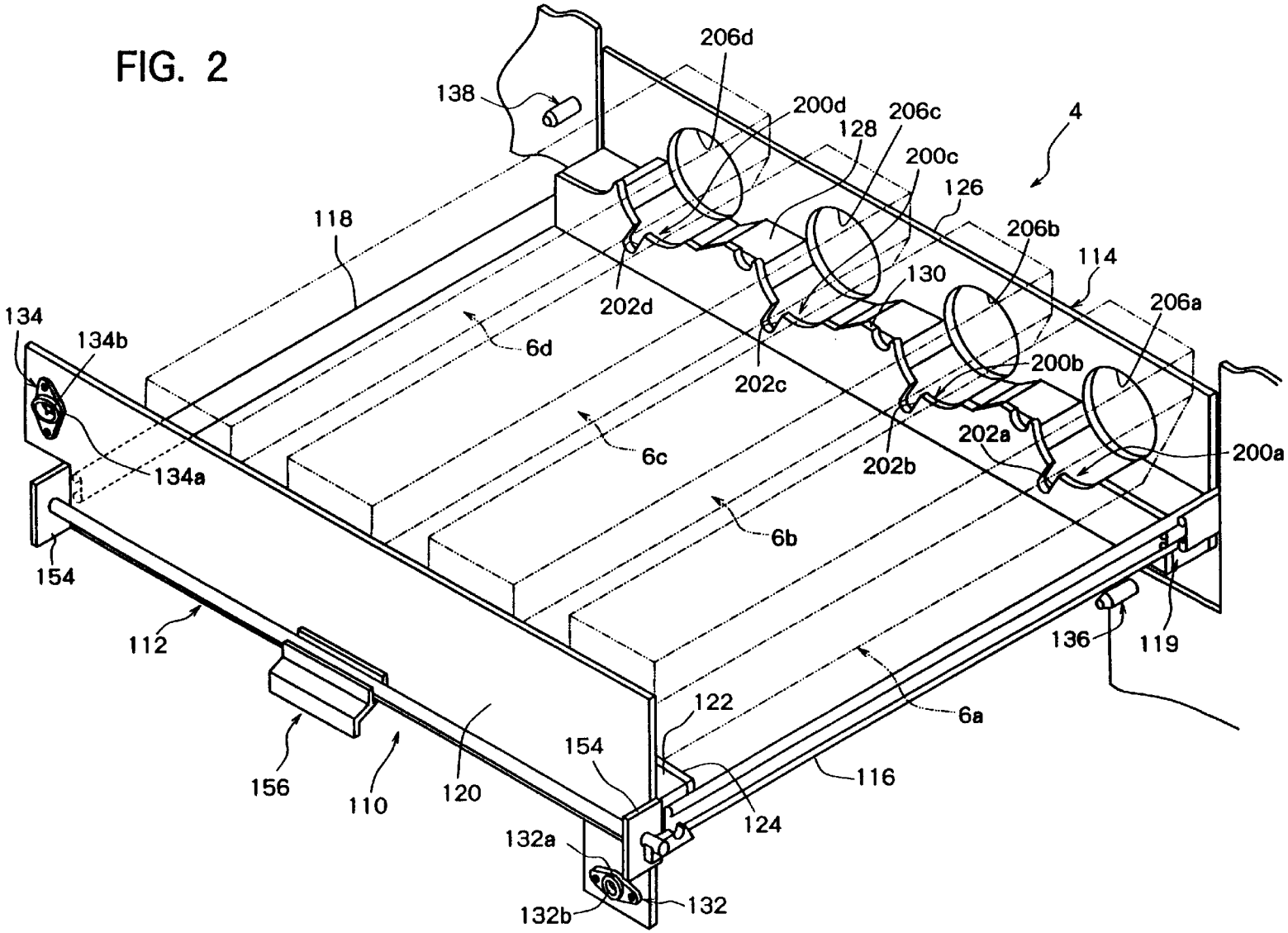
FIG. 2 is a partial perspective view illustrating an image-forming unit in the image-forming machine shown in FIG. 1 in a state where it is drawn out to the non-acting position.

FIG. 2 illustrates a state where a front cover (not shown) of the housing 2 is opened and the above-mentioned image-forming unit 4 is drawn out to the non-acting position. As clearly shown in FIG. 2, the image-forming unit 4 has a frame 110. The frame 110 has a front wall member 112, a rear wall member 114, and side wall members 116 and 118 on both sides. The end on one side of the front wall member 112 and the end on one side of the rear wall member 114 are coupled together by the side wall member 116, and the end on the other side of the front wall member 112 and the end on the other side of the rear wall member 114 are coupled together by the side wall member 118. The frame 110 is mounted at its both side wall members 116 and 118 on the housing 2 via a suitable mounting means 119 (e.g., a mounting means placed in the market in the trade name of "Accuride", part of which is illustrated in FIG. 2) so as to freely move substantially horizontally between the acting position in the housing 2 and the non-acting position (i.e., a position shown FIG. 2) drawn out forward from the acting position. The above-mentioned image-forming means 6*a*, 6*b*, 6*c* and 6*d* are detachably mounted on the frame 110 being arranged in tandem in a direction substantially perpendicular to the direction in which the frame 110 moves and substantially in a horizontal direction, i.e., in the right-and-left direction in FIG. 1. The manner of mounting the image-forming means 6*a*, 6*b*, 6*c* and 6*d* on the frame 110 will be described later in further detail.

Figure 3:
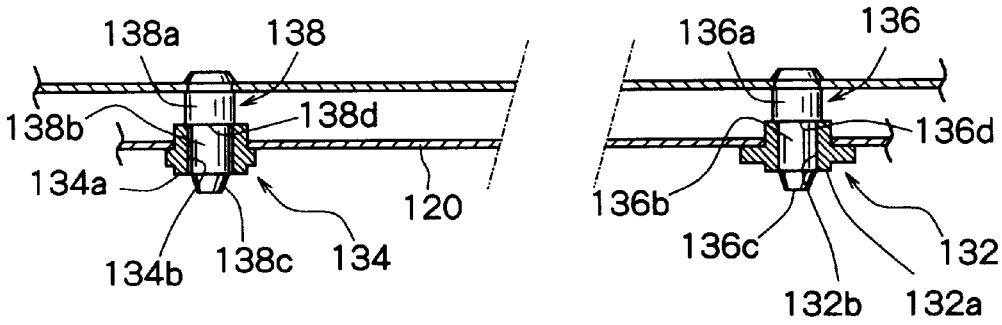
FIG. 3 is a partial sectional view illustrating a pair of position-limiting means arranged on a front wall member in the image-forming unit, which work in cooperation with a pair of front stationary position-limiting means arranged in a housing, in the image-forming machine shown in FIG. 1.
Figure 4:
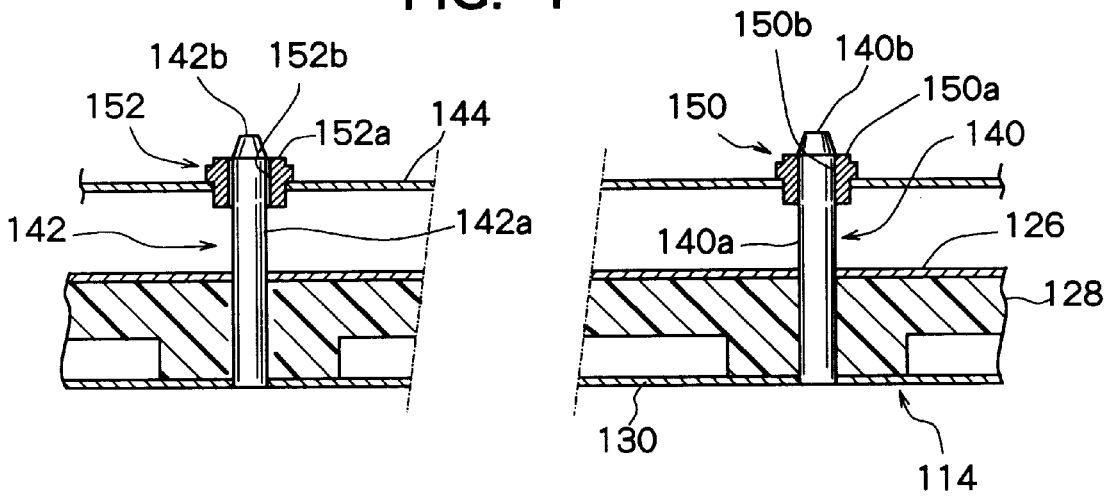
FIG. 4 is a partial sectional view illustrating a pair of position-limiting means arranged on a rear wall member in the image-forming unit, which work in cooperation with a pair of rear stationary position-limiting means arranged in the housing, in the image-forming machine shown in FIG. 1.

If further described with reference to FIG. 2, in the illustrated embodiment, the front wall member 112 of the frame 110 is constituted by three pieces of plates that are coupled together by bolts or joined together by a suitable means such as adhesion, i.e., constituted by an outer plate 120 which is a steel plate, an intermediate plate 122 and an inner mounting plate 124 that are made of a synthetic resin. Similarly, the rear wall member 114 of the frame 110 is constituted by three pieces of plates that are coupled together by bolts or joined together by a suitable means such as adhesion, i.e., constituted by an outer plate 126 which is a steel plate, an intermediate plate 128 and an inner mounting plate 130 that are made of a synthetic resin. If described with reference to FIG. 2 together with FIG. 3, in the front wall member 112 of the frame 110, the outer plate 120 has protruded portions on both sides thereof, and limiting members 132 and 134 are secured to the protruded portions. The limiting member 132 has a main portion 132*a* of a cylindrical shape that extends substantially horizontally, and in the main portion 132*a* is formed a through receiving hole 132*b* having a circular shape in cross section. The limiting member 134 has a main portion 134*a* of a flat circular shape that extends substantially horizontally, and in the main portion 134*a* is formed a through receiving hole 134*b* of an elongated shape extending in the transverse direction in cross section. A pair of pins 136 and 138 are secured to the front portion of the housing 2 via suitable support brackets. The pins 136 and 138 are arranged substantially horizontally, and have cylindrical base portions 136*a* and 138*a* of a relatively large diameter, intermediate portions 136*b* and 138*b* of a cylindrical shape, and end portions 136*c* and 138*c* that are tapered. Annular shoulder surfaces 136*d* and 138*d* are formed between the base portions 136*a*, 138*a* and the intermediate portions 136*b*, 138*b*. The inner diameter of the receiving hole 132*b* is substantially the same as the outer diameter of the intermediate portion 136*b* of the pin 136, and the width of the receiving hole 134*b* is substantially the same as the outer diameter of the intermediate portion 138*b* of the pin 138. If described with reference to FIG. 2 together with FIG. 4, on the rear wall member 114 of the frame 110, there are disposed a pair of pins 140 and 142 that protrude rearward from the base ends secured to the inner mounting plate 130, penetrating through the intermediate plate 128 and the outer plate 126. These pins 140 and 142 are arranged substantially horizontally, and have main cylindrical portions 40*a* and 142*a*, and tapered end portions 140*b* and 142*b*. On the other and, an upright substrate 144 is disposed at the rear part of the housing 2, and a pair of limiting members 150 and 152 are secured to the upright substrate 144. The limiting member 150 has a main portion 150*a* of a cylindrical shape that extends substantially horizontally, and in the main portion 150*a* is formed a through receiving hole 150*b* having a circular shape in cross section. The limiting member 152 has a main portion 152*a* of a flat cylindrical shape that extends substantially horizontally, and in the main portion 152*a* is formed a through receiving hole 152*b* having an elongated shape extending in the transverse direction in cross section. The inner diameter of the receiving hole 150*b* is substantially the same as the outer diameter of the main portion 140*a* of the pin 140, and the width of the receiving hole 152*b* is substantially the same as the outer diameter of the main portion 142*a*. As will be comprehended with reference to FIG. 2 together with FIGS. 3 and 4, when the frame 110 of the image-forming unit 4 is moved rearward from the non-acting position shown in FIG. 2 to the acting position shown in FIGS. 1, 3 and 4, the pins 136 and 138 disposed on the front part of the housing 2 are inserted up to their intermediate portions 136*b* and 138*b* in the receiving holes 132*b* and 134*b* disposed in the front wall member 112 of the frame 110, and the annular shoulder surfaces 136*d* and 138*d* of the pins 136 and 138 come into contact with the ends of the main portions 132*a* and 134*a* of the limiting members 132 and 134 (i.e., ends of the receiving holes 132*b* and 134*b*). Furthermore, the pins 140 and 142 disposed in the rear wall member 114 of the frame 110 are inserted in the receiving holes 150*b* and 152*b* disposed in the rear part of the housing 2. Even it there exists considerable play in the mounting means 120, the frame 110 is positioned relative to the housing 2 on one side of the frame 110 in the back-and-forth direction with a sufficient degree of precision, owing to the cooperation of the pin 136 and the receiving hole 132*b* and the cooperation of the pin 140 and the receiving hole 150*b*. Furthermore, owing to the cooperation of the pin 138 and the receiving hole 134*b* and the cooperation of the pin 142 and the receiving hole 152*b*, the frame 110 is prevented from turning about the above-mentioned one side as a center or, more specifically, about the center axis of the pins 136 and 140 as a center. Accordingly, the receiving holes 132*b* and 134*b* disposed in the front wall member 112 of the frame 110 constitute a pair of position-limiting means which works in cooperation with a pair of front stationary position-limiting means constituted by the pins 136 and 138 disposed on the front part of the housing 2. The pins 140 and 142 disposed on the rear wall member 114 of the frame 110 constitute a pair of position-limiting means which work in cooperation with the rear stationary position-limiting means constituted by the receiving holes 150*b* and 152*b* disposed at the rear part of the housing 2. Further, the position of the frame 110 in the back-and-forth direction relative to the housing 2 is limited as the annular shoulder surfaces 136*d* and 138*d* of the pins 136 and 138 come into contact with the ends of the main portions 132*a* and 134*a* of the limiting members 132 and 134 (i.e., ends of the receiving holes 132*b* and 134*b*). Thus, although the image-forming unit 4 is allowed to be selectively brought to the acting position and to the non-acting position very easily, the image-forming unit 4 is placed to a predetermined position in the housing 2 with a sufficient degree of precision, when brought to the acting position. Then, when the frame 110 is moved to the acting position, the locking means automatically locks the frame 110 to the acting position, as will be described below.

Figure 5:
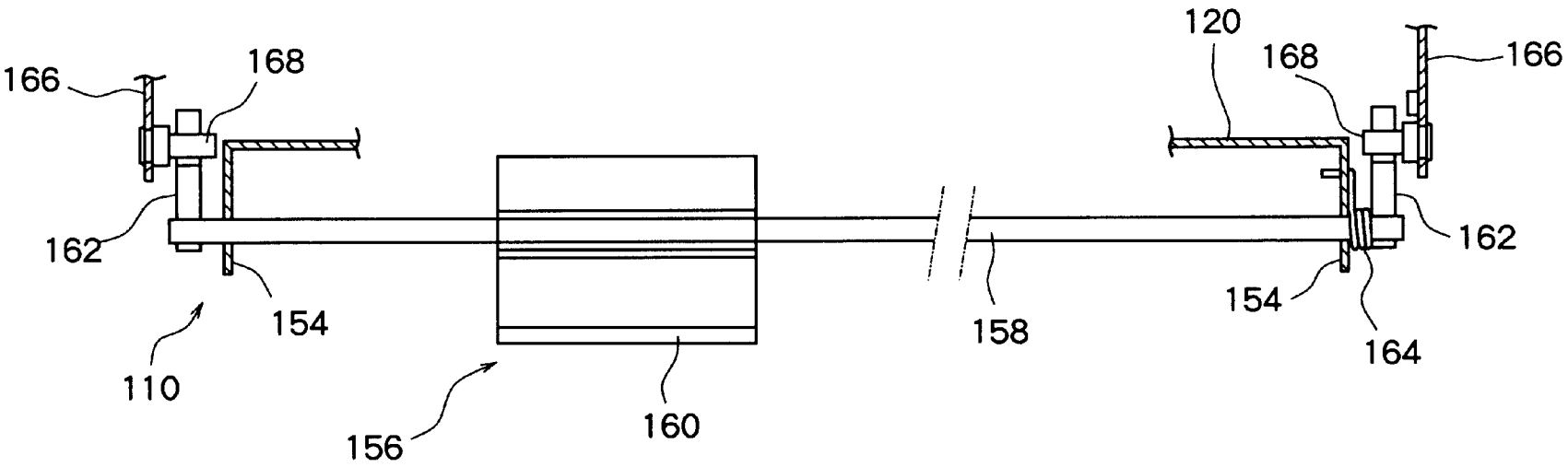
FIG. 5 is a partial sectional view illustrating a locking means arranged in the image-forming unit in the image-forming machine shown in FIG. 1.
Figure 6:
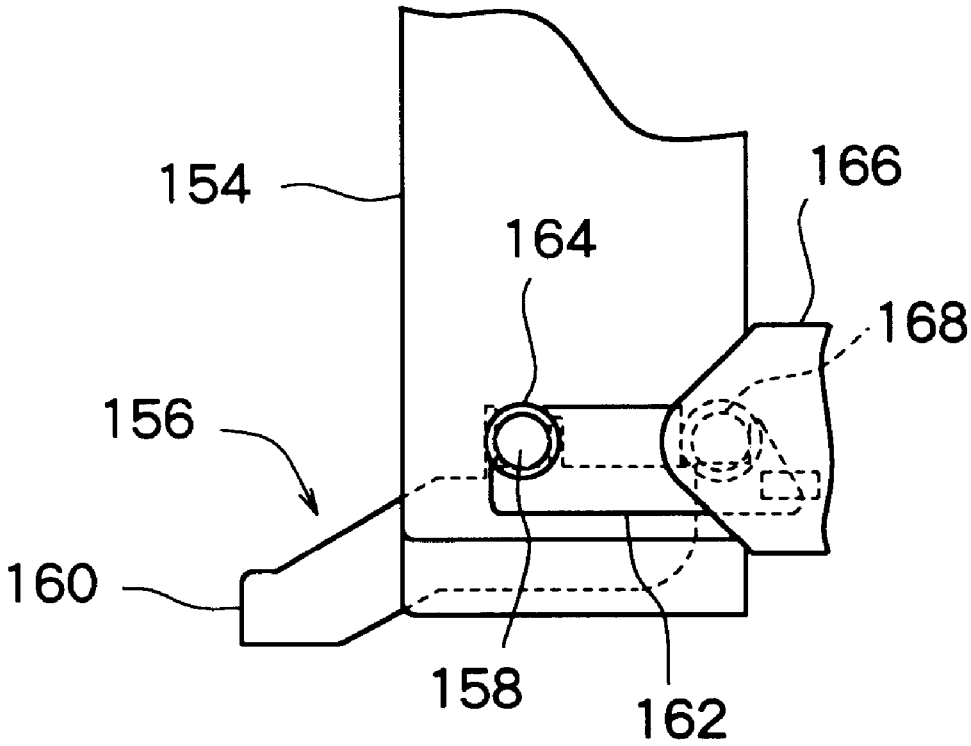
FIG. 6 is a partial side view illustrating the locking means shown in FIG. 5.

The locking means will now be described with reference to FIGS. 5 and 6. On the outer plate 120 of the front wall member 112 of the frame 110, there are formed a pair of upright walls 154 that protrude forward at a distance in the transverse direction, and a locking means 156 is mounted on the upright walls 154. The locking means 156 is constituted by a rotary shaft 158 rotatably mounted between the upright walls 154, an operation lever 160 secured to a central portion of the rotary shaft 158, and hooks 162 secured to both ends of the rotary shaft 158 that extend beyond the upright walls 154. At one end of the rotary shaft 158 (right end in FIG. 5), there is disposed a coil spring 164 with its one end being secured to the upright wall 154 and its other end being secured to the rotary shaft 158 in order to resiliently urge the rotary shaft 158 in the counterclockwise direction in FIG. 6. The rotary shaft 158, operation lever 160 and hooks 162 are resiliently urged toward the locking position indicated by solid lines in FIGS.5 and 6. A stopper piece (not shown) is disposed on the front surface of the outer plate 120. When the locking means 156 is brought to the locking position indicated by a solid line in FIGS. 5 and 6, the operation lever 160 comes in contact with the stopper piece so that the locking means 156 is prevented from turning in the counterclockwise direction in FIG. 6 beyond the locking position. As clearly shown in FIG. 6, the rear end edge of the hooks 162 is tilted downward toward the rear side (toward the right in FIG. 6). On the front part of the housing 2, too, there are arranged a pair of upright walls 166 protruding forward on both sides of the upright walls 154, and lock pins 168 are secured to the upright walls 166. When the frame 110 moves to the acting position shown in FIGS. 1, 3 to 6 from the non-acting position that is drawn forward from the housing 2, the rear end edges of the hooks 162 of the locking means 156 come in contact with the lock pins 168, whereby the locking means 156 is turned to some extent in the clockwise direction in FIG. 6 against the resilient urging action of the coil spring 164. Then, as the ends of the hooks 162 pass over the lock pins 168, the locking means 156 is caused to turn up to the locking position in the counterclockwise direction in FIG. 6 due to the resilient urging action of the coil spring 164, whereby the hooks 162 are brought into engagement with the lock pins 168. Thus, the frame 110 or the image-forming unit 4 is releasably locked at the acting position. To draw out the image-forming unit 4 to the non-acting position, the operation lever 160 of the locking means 156 is turned by a finger in the clockwise direction in FIG. 6, so that the hooks 162 are liberated from the lock pins 168 and then, are pulled forward.

Figure 7:
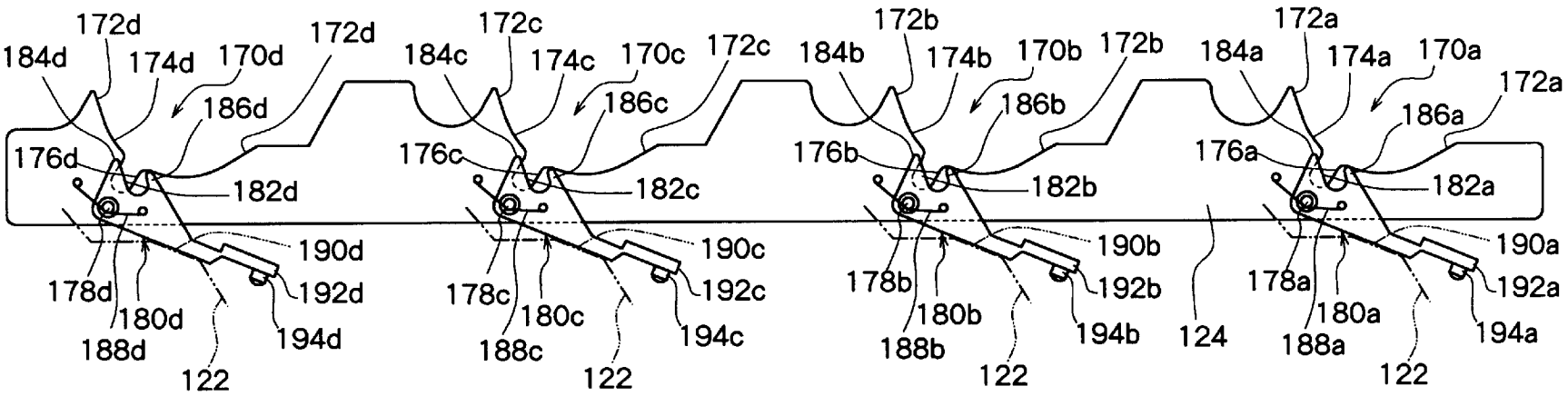
FIG. 7 is a front view illustrating an inner mounting plate of the front wall member in the image-forming unit shown in FIG. 2.

If further described with reference to FIG. 2 together with FIG. 7, four mounting notches 170*a*, 170*b*, 170*c* and 170*d* are formed in the inner mounting plate 124 of the front wall member 112 of the image-forming unit 110 at a predetermined distance in the right-and-left direction in FIG. 7. The mounting notches 170*a*, 170*b*, 170*c* and 170*d* are opened upward. The mounting notches 170*a*, 170*b*, 170*c* and 170*d* in the illustrated embodiment have support edges 172*a*, 172*b*, 172*c* and 172*d* that extend straight in the neighborhood of both ends thereof. Edges 174*a*, 174*b*, 174*c* and 174*d* positioned between the support edges 172*a*, 172*b*, 172*c* and 172*d* may have an arcuate shape. In the central portions of the arcuate edges 174*a*, 174*b*, 174*c* and 174*d*, there are formed mounting slits 176*a*, 176*b*, 176*c* and 176*d* that extend downward being inclined toward the left side in FIG. 7. Considerably large notches are formed in the intermediate plate 122 of the front wall member 112 to correspond to the mounting notches 170*a*, 170*b*, 170*c* and 170*d* and to the mounting slits 176*a*, 176*b*, 176*c* and 176*d* of the inner mounting plate 124.

If further described with reference to FIG. 7, mounting pins 178*a*, 178*b*, 178*c* and 178*d* that protrude substantially horizontally are secured to the outer surface of the inner mounting plate 124 in relation with the mounting slits 176*a*, 176*b*, 176*c* and 176*d*, and locking members 180*a*, 180*b*, 180*c* and 180*d* are rotatably mounted on the mounting pins 178*a*, 178*b*, 178*c* and 178*d*. The locking members 180*a*, 180*b*, 180*c* and 180*d* have pairs of arms 184*a*, 184*b*, 184*c*, 184*d* and 186*a*, 186*b*, 186*c* and 186*d* that define lock slits 182*a*, 182*b*, 182*c* and 182*d*. The width of the lock slits 182*a*, 182*b*, 182*c* and 182*d* may be substantially the same as the width of the mounting slits 176*a*, 176*b*, 176*c* and 176*d*. Resilient urging means 188*a*, 188*b*, 188*c* and 188*d* constituted by coil springs are fitted onto the mounting pins 178*a*, 178*b*, 178*c* and 178*d*, the ends on one side of the resilient urging means 188*a*, 188*b*, 188*c* and 188*d* being secured to the inner mounting plate 124 and the ends on the other side thereof being secured to the locking members 180*a*, 180*b*, 180*c* and 180*d*. The resilient urging means 188*a*, 188*b*, 188*c* and 188*d* resiliently urge the locking members 180*a*, 180*b*, 180*c* and 180*d* with a relatively small force in the clockwise direction in FIG. 7, and bring the locking members 180*a*, 180*b*, 180*c* and 180*d* to unlocking positions shown in FIG. 7. At the unlocking positions, the lower edges of the locking members 180*a*, 180*b*, 180*c* and 180*d* come in contact with contact edges 190*a*, 190*b*, 190*c* and 190*d* of the intermediate plate 122, whereby the locking members 180*a*, 180*b*, 180*c* and 180*d* are prevented from turning in the clockwise direction beyond the unlocking positions. At the unlocking positions, the arms 184*a*, 184*b*, 184*c* and 184*d* on one side of the locking members 180*a*, 180*b*, 180*c* and 180*d* extend across the mounting slits 176*a*, 176*b*, 176*c* and 176*d*, and the arms 186*a*, 186*b*, 186*c* and 186*d* on the other side are retracted from the mounting slits 176*a*, 176*b*, 176*c* and 176*d*.

Figure 9:
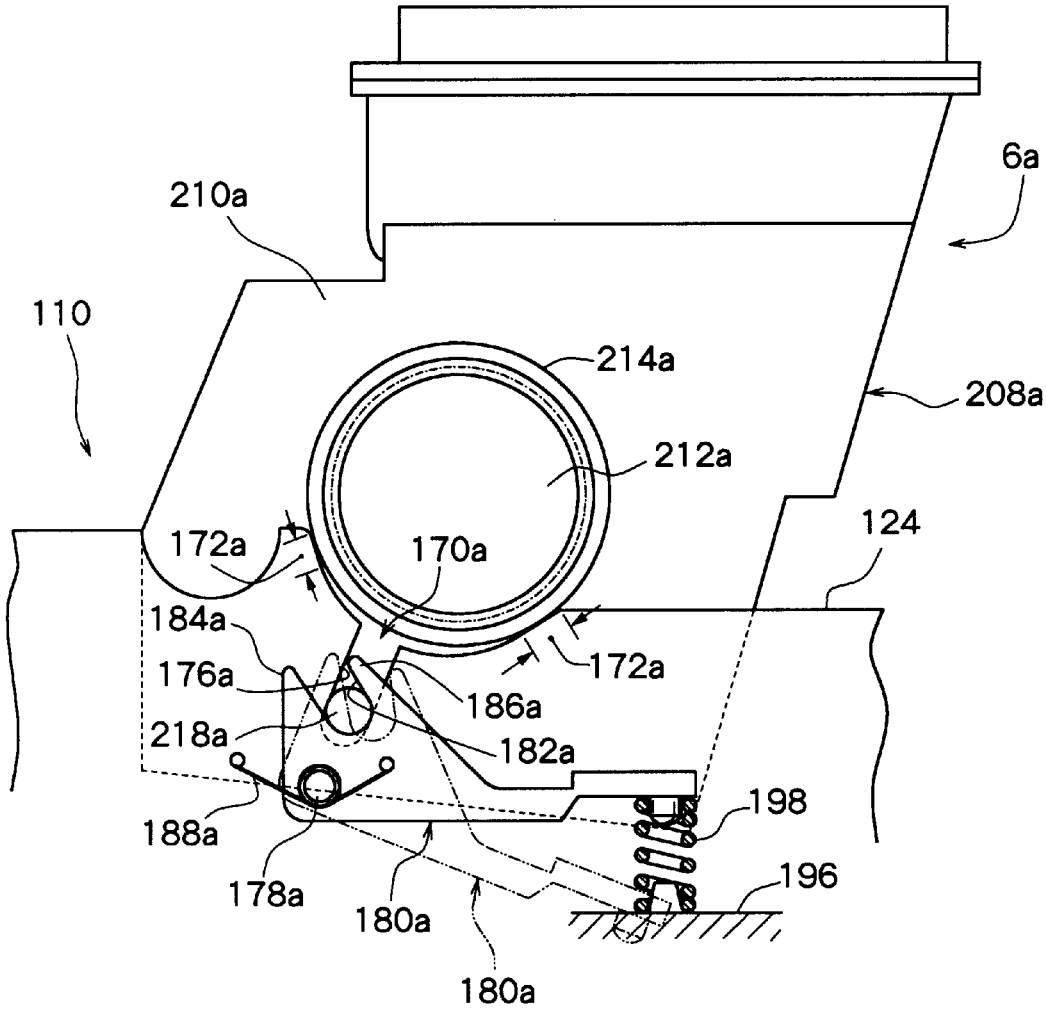
FIG. 9 is a partial enlarged view illustrating a manner of mounting the image-forming means on a frame in the image-forming unit shown in FIG. 2.

The locking members 180*a*, 180*b*, 180*c* and 180*d* have, respectively, input levers 192*a*, 192*b*, 192*c* and 192*d*, and cylindrical protrusions 194*a*, 194*b*, 194*c* and 194*d* are formed at the front lower edges of the input levers 192*a*, 192*b*, 192*c* and 192*d*. As will be further described later with reference to FIG. 9, the afore-mentioned transfer belt means 22 is equipped with a lift frame 196 (on which are mounted the afore-mentioned driven roller 24, tension roller 26, transfer rollers 28*a*, 28*b*, 28*c* and 28*d*, and auxiliary roller 30). Four resilient urging means 198 which may be coil springs (only one of them is shown in FIG. 9) are disposed on the lift frame 196. When the transfer belt means 22 is descended to the non-acting position indicated by a two-dotted chain line in FIG. 1, the resilient urging means 198 are separated away from the locking members 180*a*, 180*b*, 180*c* and 180*d*. When the transfer belt means 22 is ascended to the acting position indicated by a solid line in FIG. 1, however, the resilient urging means 198 are fitted to the cylindrical protrusions 194*a*, 194*b*, 194*c* and 194*d*, come in contact with the front lower edges of the input levers 192*a*, 192*b*, 192*c* and 192*d* of the locking members 180*a*, 180*b*, 180*c* and 180*d*, and resiliently urge the locking members 180*a*, 180*b*, 180*c* and 180*d* with a relatively strong force (i.e., urging force considerably larger than the urging force of the resilient urging means 188*a*, 188*b*, 188*c* and 188*d*) in the counterclockwise direction in FIGS. 7 and 9.

The inner mounting plate 130 and the intermediate plate 128 of the rear wall member 114 of the frame 110 are substantially the same as the inner mounting plate 124 and the intermediate plate 122 of the front wall member 112. As illustrated in FIG. 2, four mounting notches 200*a*, 200*b*, 200*c*, 200*d* and four mounting slits 202*a*, 202*b*, 202*c* and 202*d* are formed in the inner mounting plate 130 of the rear wall member 114, and four locking members (not shown) are mounted on the outer surface of the inner mounting plate 130. On the lift frame 196 of the transfer belt means 22 are disposed resilient urging means (not shown) that act upon the four locking members mounted on the inner mounting plate 130. In the rear wall member 114, furthermore, four relatively large circular openings 206*a*, 206*b*, 206*c* and 206*d* are formed in the outer plate 126 to correspond to the four mounting notches 200*a*, 200*b*, 200*c* and 200*d* of the inner mounting plate 130.

Figure 8:
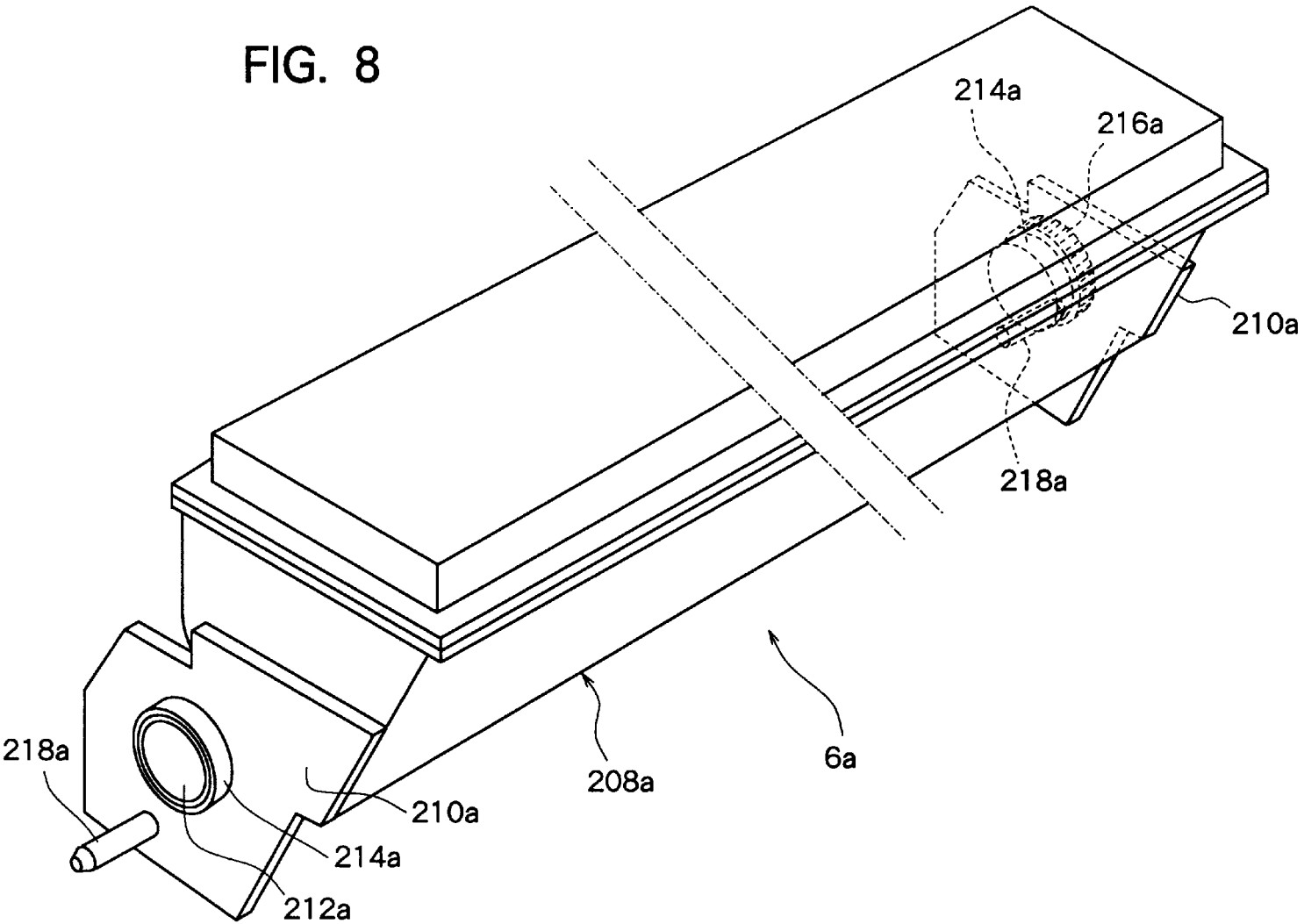
FIG. 8 is a perspective view illustrating an image-forming means in the image-forming unit shown in FIG. 2.

FIG. 8 illustrates a black toner image-forming means 6*a* which includes a case 208*a* that can be molded using a suitable synthetic resin. The case 208*a* has both end walls 210*a* on which are rotatably mounted a rotary shaft 212*a* via bearing members 214*a*. The bearing members 214*a* may be of a known form having an inner race with a cylindrical inner peripheral surface and an outer race with a cylindrical outer peripheral surface, the inner race being secured to the rotary shaft 212*a* and the outer race being secured to the side wall 210*a*. The bearing members 214*a* protrude outward beyond the outer surfaces of both side walls 210*a*. The rotary drum 8*a* (FIG. 1) is mounted on the main portion of the rotary shaft 212*a*, i.e., on a portion located in the case 208*a*. The rear end of the rotary shaft 212*a* extends rearward beyond the bearing member 214*a*, and an input gear 216*a* is fitted to the extended end portion. Engaging pins 218*a* are secured to both end walls 210*a* of the case 208*a*, at positions below the rotary shaft 212*a*. The engaging pins 218*a* protrude from the outer surfaces of both end walls 210*a* substantially in parallel with the rotary shaft 212*a*. Three other image-forming means, i.e., the magenta toner image-forming means 6*b*, cyan toner image-forming means 6*c* and yellow toner image-forming means 6*d*, are constituted substantially in the same manner as the black toner image-forming means 6*a*.

Described below with reference to FIG. 2 and FIGS. 7 to 9 is a manner of mounting the image-forming means 6*a* on the frame 110. The case 208*a* of the image-forming means 6*a* is positioned between the front wall member 112 and the rear wall member 114 of the frame 110, engaging pins 218*a* secured to both end walls 210*a* of the case 28*a* are introduced into the mounting slits 17 6*a* formed in the inner mounting plate 124 of the front wall member 112 and into the mounting slits 202*a* formed in the inner mounting plate 130 of the rear wall member 114, and bearing members 214*a* fitted to both ends of the rotary shaft 212*a* are introduced into the mounting notches 170*a* formed in the inner mounting plate 124 of the front wall member 112 and into the mounting notches 200*a* formed in the inner mounting plate 130 of the rear wall member 114. As clearly shown in FIG. 9, when the bearing member 214*a* is introduced into the mounting notch 170*a*, the two support edges 172*a* of the mounting notch 170*a* come in contact with the outer peripheral surface of the bearing member 214*a* thereby to support the bearing member 214*a* at two positions at a distance in the circumferential direction. The outer circumference of the bearing member 214*a* is of a cylindrical shape, whereas the support edges 172*a* of the mounting notch 170*a* are straight. Therefore, the support edges 172*a* come in point-contact with the bearing member 214*a* as viewed on a front view. If the thickness of the inner mounting plate 124 is taken into consideration, this contact is a line contact along the line extending in a direction perpendicular to the surface of the paper in FIG. 9. Therefore, when the support edge 172*a* is formed sufficiently precisely, the bearing member 214*a* can be brought to a predetermined position with a sufficient degree of precision. On the other hand, the engaging pin 218*a* introduced in the mounting slit 176*a* interferes with one arm 184*a* of the locking member 180*a*, and turns the locking member 180*a* in the counterclockwise direction in FIG. 9, against the resilient urging action of the resilient urging means 188*a*. And, when the engaging pin 218*a* is lowered down to a position where the bearing member 214*a* comes in contact with the support edge 172*a* of the mounting notch 170*a*, the locking member 180*a* is brought to a locking position shown in FIG. 9. When the locking member 180*a* is turned up to the locking position, the engaging pin 218*a* is held in the lock slit 182*a*, one arm 184*a* of the locking member 180*a* is positioned beneath the engaging pin 218*a*, and the other arm 186*a* of the locking member 180*a* is positioned above the engaging pin 218*a*. The bearing member 214*a* and the engaging pin 218*a* disposed on the rear side of the case 208*a* are similarly supported and held by the mounting notch 200*a* and mounting slit 202*a* formed in the inner mounting plate 130 of the rear wall member 114. The input gear 216*a* fitted to the rear end of the rotary shaft 212*a* is positioned on the rear side of the rear wall member 114 passing through a circular opening 206*a* formed in the outer plate 126 of the rear wall member 114. Three other image-forming means, i.e., magenta toner image-forming means 6*b*, cyan toner image-forming means 6*b* and yellow toner image-forming means 6*d*, are mounted on the frame 110 in substantially the same manner as the black toner image-forming means 6*a*.

When the frame 110 on which the image-forming means 6*a*, 6*b*, 6*c* and 6*d* are mounted, is brought to the acting position in the housing 2, the input gears (FIG. 8 shows only the input gear 216*a* of the black toner image-forming means 6*a*) of the image-forming means 6*a*, 6*b*, 6*c* and 6*d* are coupled to the transmission gears (not shown) mounted in the housing 2, and are further coupled to a rotary drive source which may be an electric motor through the transmission gears. Furthermore, when the lift frame 196 of the transfer belt means 22 is ascended to the acting position after the frame 110 of the image-forming unit 4 is brought to the acting position in the housing 2, eight resilient urging means 198 disposed on the lift frame 196 act upon the locking members 180*a*, 180*b*, 180*c* and 180*d* to resiliently urge them to the locking positions with a relatively strong force as shown in FIG. 9. Thus, the other arms 186*a*, 186*b*, 186*c* and 186*d* of the locking members 180*a*, 180*b*, 180*c* and 180*d* come into engagement with the engaging pins (engaging pins 218*a*, etc. shown in FIGS. 8 and 9) from the upper side, so that the engaging pins are prevented from disengaging upward from the mounting slits 176*a*, 176*b*, 176*c*, 176*d* and 202*a*, 202*b*, 202*c* and 202*d*. Therefore, the image-forming means 6*a*, 6*b*, 6*c* and 6*d* are held at required mounting positions of the frame 110 with a sufficient degree of reliability by the action of the locking members 180*a*, 180*b*, 180*c* and 180*d* that are held at the locking positions due to their own weights and due to the resilient urging means 198. Furthermore, since the engaging pins (engaging pins 218*a*, etc. shown in FIGS. 8 and 9) are locked in the mounting slits 176*a*, 176*b*, 176*c*, 176*d* and 202*a*, 202*b*, 202*c* and 202*d*, the image-forming means 6*a*, 6*b*, 6*c* and 6*d* are reliably prevented from swinging or turning.

Figure 10:
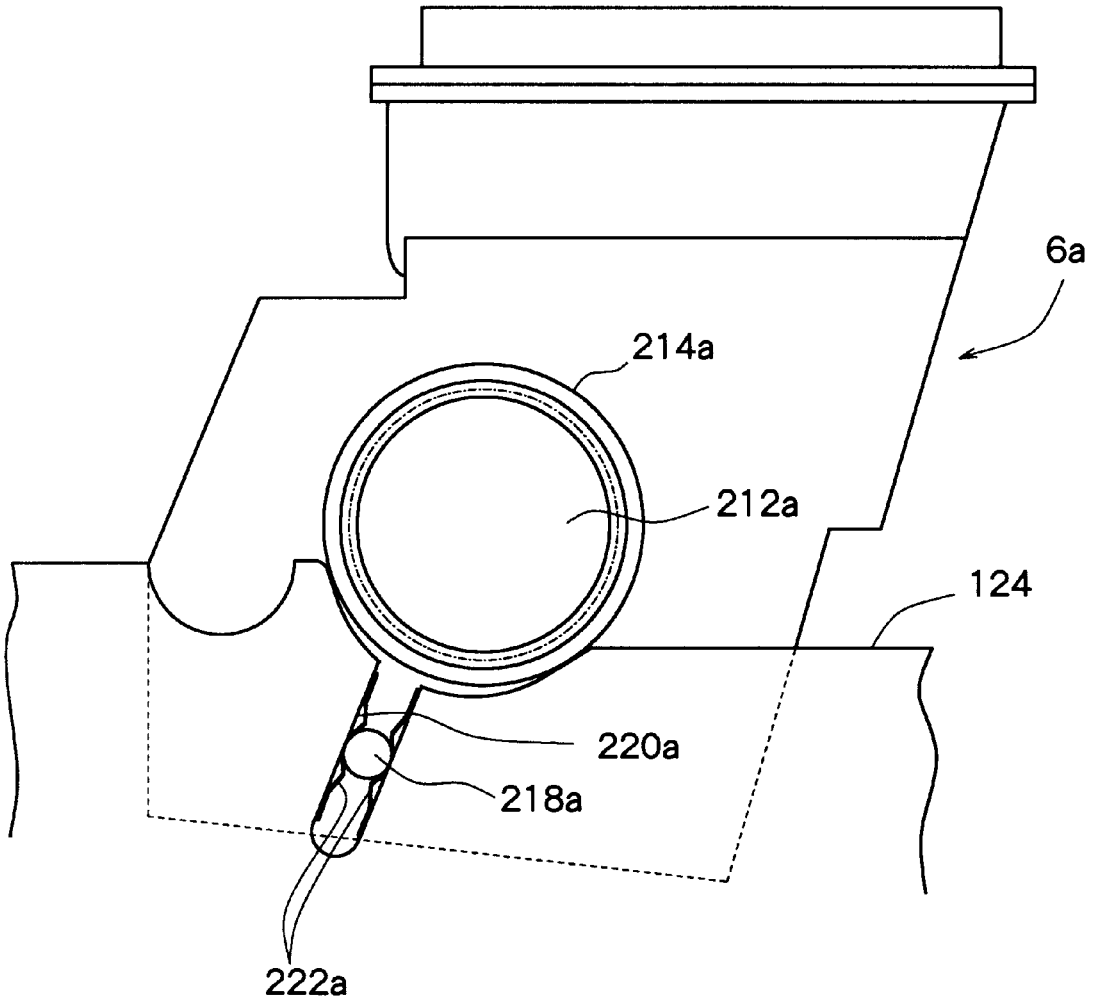
FIG. 10 is a partial enlarged view similar to FIG. 9, and illustrates a modified example of the locking means.

FIG. 10 illustrates a modified example of the mounting slit formed in the inner mounting plate 124. In this modified example, holding members 222*a* are secured to both side edges of the mounting slit 220*a*. The holding members 222*a* formed of a spring steel plate has a recessed portion at the central portion in the lengthwise direction thereof. The engaging pin 218*a* introduced into the mounting slit 222*a* causes the holding members 222*a* to be resiliently deformed, and is positioned between the recessed portions and is resiliently held at this position.

Though the preferred embodiments of the image-forming machine constituted according to the present invention were described above in detail with reference to the accompanying drawings, it should be noted that the invention is in no way limited to the above-mentioned embodiments only but can be modified or change in various other ways without departing from the scope of the invention.

What we claim is:

1. An image-forming machine comprising a housing and an image-forming unit allowed to freely move substantially horizontally between an acting position in said housing and a non-acting position drawn forward from said acting position, said image-forming unit including a frame that has a front wall member and a rear wall member arranged at a distance in a back-and-forth direction;

wherein a pair of position-limiting means are arranged at a distance in a direction transverse to the back-and-forth direction on each of said front wall member and said rear wall member of said frame in said image-forming unit, and said housing includes a pair of front stationary position-limiting means and a pair of rear stationary position-limiting means, and when said image-forming unit is brought to said acting position, said pair of position-limiting means of said front wall member work in cooperation with said pair of front stationary position-limiting means and said pair of position-limiting means of said rear wall member work in cooperation with said pair of rear stationary position-limiting means, so that said image-forming unit is limited to said acting position, and wherein, amongst said pair of position-limiting means of said front wall member and said pair of front stationary position-limiting means, there is included a first pair of receiving holes that extend substantially horizontally, and a first pair of pins that extend substantially horizontally; and, amongst said pair of position-limiting means of said rear wall member and of said pair of rear stationary position-limiting means, there is included a second pair of pins that extend substantially horizontally and a second pair of receiving holes that extend substantially horizontally, and wherein annular shoulder surfaces are formed on said first pair of pins, and front ends of said first pair of receiving holes come into contact with said annular shoulder surfaces thereby to limit the position of said image-forming unit in the back-and-forth direction.

2. An image-forming machine comprising a housing and an image-forming unit allowed to freely move substantially horizontally between an acting position in said housing and a non-acting position drawn forward from said acting position, said image-forming unit including a frame that has a front wall member and a rear wall member arranged at a distance in a back-and-forth direction;

wherein a pair of position-limiting means are arranged at a distance in a direction transverse to the back-and-forth direction on each of said front wall member and said rear wall member of said frame in said image-forming unit, and said housing includes a pair of front stationary position-limiting means and a pair of rear stationary position-limiting means and when said image-forming unit is brought to said acting position, said pair of position-limiting means of said front wall member work in cooperation with said pair of front stationary position-limiting means and said pair of position-limiting means of said rear wall member work in cooperation with said pair of rear stationary position-limiting means, so that said image-forming unit is limited to said acting position, and wherein, amongst said pair of position-limiting means of said front wall member and said pair of front stationary position-limiting means, there is included a first pair of receiving holes that extend substantially horizontally, and a first pair of pins that extend substantially horizontally; and, amongst said pair of position-limiting means of said rear wall member and of said pair of rear stationary position-limiting means, there is included a second pair of pins that extend substantially horizontally and a second pair of receiving holes that extend substantially horizontally, and wherein annular shoulder surfaces are formed on said second pair of pins, and front ends of said second pair of receiving holes come into contact with said annular shoulder surfaces thereby to limit the position of said image-forming unit in the back-and-forth direction.

3. An image-forming machine comprising a housing and an image-forming unit allowed to freely move substantially horizontally between an acting position in said housing and a non-acting position drawn forward from said acting position, said image-forming unit including a frame that has a front wall member and a rear wall member arranged at a distance in a back-and-forth direction;

wherein a pair of position-limiting means are arranged at a distance in a direction transverse to the back-and-forth direction on each of said front wall member and said rear wall member of said frame in said image-forming unit, and said housing includes a pair of front stationary position-limiting means and a pair of rear stationary position-limiting means, and when said image-forming unit is brought to said acting position, said pair of position-limiting means of said front wall member work in cooperation with said pair of front stationary position-limiting means and said pair of position-limiting means of said rear wall member work in cooperation with said pair of rear stationary position-limiting means, so that said image-forming unit is limited to said acting position; and wherein locking means are disposed to releasably lock said image-forming unit at said acting position.

4. An image-forming machine comprising a housing and an image-forming unit allowed to freely move between an acting position in said housing and a non-acting position drawn out from said acting position, said image-forming unit including a frame that has a front wall member and a rear wall member arranged at a distance in a back-and-forth direction, and at least one image-forming means detachably mounted on said frame, and said at least one image-forming means including a rotary shaft, a rotary drum mounted on said rotary shaft, and bearing members fitted to both ends of said rotary shaft, said bearing members having a cylindrical outer peripheral surface;

wherein each of said front wall member and said rear wall member of said frame includes a mounting plate having mounting notches that are opened upward, and said mounting notches have two support edges which, when said bearing members of said image-forming means are introduced into said mounting notches from an upper side, support said bearing members at two positions which maintain a distance in a circumferential direction on the outer peripheral surfaces of said bearing members.

5. An image-forming machine according to claim 4, wherein said frame has four image-forming means that are mounted thereon, arranged in tandem, in a direction which is substantially perpendicular to the direction in which said image-forming unit moves and is substantially horizontal, said four image-forming means being a black toner image-forming means, a magenta toner image-forming means, a cyan toner image-forming means and a yellow toner image-forming means.

6. An image-forming machine according to claim 4, wherein said support edges extend straight.

7. An image-forming machine according to claim 4, wherein each mounting plate has a mounting slit that extends downward from a corresponding one of said mounting notches between said two support edges, said image-forming means has engaging pins that are positioned beneath said bearing members and protrude substantially in parallel with said rotary shaft, said mounting slits have a width corresponding to an outer diameter of said engaging pins, and said engaging pins are introduced into said mounting slits so that said bearing members are supported by said two support edges.

8. An image-forming machine according to claim 9, wherein locking members are mounted on said mounting plate to freely move between a locking position and an unlocking position and, when said locking members are moved from said unlocking position to said locking position after said engaging pins are introduced into said mounting slits, said locking members engage with said engaging pins from the upper side to prevent said engaging pins from moving upward in said mounting slits.

9. An image-forming machine according to claim 8, wherein said locking members are mounted to freely turn between said locking position and said unlocking position.

10. An image-forming machine according to claim 9, wherein said locking members have pairs of arm portions for defining a locking slit having a width corresponding to the outer diameter of said engaging pins, and when said locking members are located in said unlocking position, said pairs of arm portions include a first arm portion that extends across a corresponding mounting slit and a second arm portion retracted from a corresponding mounting slit, and when said engaging pins are introduced into said mounting slits, said engaging pins are introduced into said locking slits and come into contact with the first arm portions of said pairs of arm portions to cause said locking members to move from said unlocking position to said locking position, whereby the first arm portions of said pairs of arm portions are positioned beneath said engaging pins and the second arm portions of said pairs of arm portions are positioned above said engaging pins.

11. An image-forming machine according to claim 8, wherein resilient urging means are disposed to resiliently urge said locking members toward said unlocking position with a relatively small force.

12. An image-forming machine according to claim 11, wherein, in said housing, there is disposed a transfer belt means positioned beneath said image-forming unit when said image-forming unit is located at said acting position, said transfer belt means includes a lift frame that freely ascends and descends between an ascended position and a descended position, and said lift frame is provided with resilient urging means which are separated away from said locking members when said lift frame is located at said descended position, but, when said lift frame is brought to said ascended position, come in contact with said locking members to resiliently urge said locking members toward said locking position with a relatively large force.

13. An image-forming machine according to claim 7, wherein holding members are disposed in said mounting slits to resiliently hold said engaging pins that are introduced into said mounting slits.

* * * * *